US005197043A

United States Patent [19]

Strader

[11] Patent Number: 5,197,043

[45] Date of Patent: Mar. 23, 1993

[54] NIGHT AND DAY EARTH CLOCK CALENDAR

[76] Inventor: Verne A. Strader, 3307 92nd Ave. Ct., E, Puyallup, Wash. 98371

[21] Appl. No.: 677,497

[22] Filed: Mar. 29, 1991

[51] Int. Cl.[5] ..... G04B 19/22

[52] U.S. Cl. ..... 368/27; 368/23; 368/28

[58] Field of Search ..... 368/21-27, 368/15-18

[56] References Cited

U.S. PATENT DOCUMENTS

| | | | |
|---|---|---|---|
| 197,246 | 11/1877 | Cates | 368/27 |
| 557,173 | 3/1896 | Thompson | 368/27 |
| 641,540 | 1/1900 | Pheils | 368/27 |
| 1,344,913 | 6/1920 | Long | 368/27 |
| 1,990,012 | 2/1935 | Woodruff | 368/27 |
| 2,245,842 | 6/1941 | Werner | 368/27 |
| 2,657,525 | 11/1953 | Allen | 368/27 |
| 4,579,468 | 4/1986 | Shannon | 368/27 |

*Primary Examiner*—Bernard Roskoski

[57] ABSTRACT

A clock, a calendar, and a two dimensional model of the earth viewed looking at the polar axis as the earth is rotated during a twenty-four hour period thus showing day and night, dawn and dusk. The shadow cast on the earth by the absence of the sun's rays are also shown. The changing of said shadow to show the seasons of the year is also shown as the shadow is rotated once every 365 days. The disc containing the rotating shadow has a pointer that tells the observer the month of the year and the day of the month along with the sign of the zodiac. The rotating earth map has symbols to represent the major cities of the earth and a symbol to represent the pole.

6 Claims, 3 Drawing Sheets

NIGHT AND DAY EARTH CLOCK CALENDAR

BACKGROUND OF THE INVENTION

1. Field of the Invention

This invention relates in general to clocks and in particular to a calendar clock which shows the rotation of the earth through night and day; it shows the earth in shadow as half of the earth turns away from the sun's rays; it shows the month and day of the year and it shows the position of certain major cities as each city revolves through night and day. It also shows the position of the north pole, and it shows parts of the earth that lay between the equator and the Tropic of Capricorn. It also shows the 24 time zones that make up the earth's meridians.

2. Prior Art

It is well known that there are many devices for showing the earth's relationship to the sun and also to the time of day. Some of these are earth globes which are usually shown set at a 23½° tilt from the vertical. By shining a light on the globe's surface and rotating said globe, one can obtain a good idea of the earth's relationship to the sun and subsequently the time of day for specific places on the earth's surface. Unfortunately, it is rather difficult to carry a globe with you when you are traveling or carrying out business. Therefore it is my idea to combine a clock and a globe in a convenient package such as a wrist watch. This said watch will do all these functions above mentioned and more. My clock or watch is not limited however to just a wrist watch. It may be a wall mount, desk top or any other size watch or clock. My invention is a two dimensional solution to this problem. Students of astronomy, international businessmen, military personnel, travelers, pilots, and people in general would be interested in this clock or watch.

Other two dimensional "earth clocks" are listed below.

The D. W. Thompson "Geographical Clock Dial" U.S. Pat. No. 557,173, Mar. 31, 1896. This device uses a movable screen to show the earth's shadow and must be adjusted from time to time. The north pole (or south pole) is not adjusted for the earth's tilting axis. The clock is a twenty-four hour clock and runs in a counter clockwise direction making this device hard to read. There is no system for the days or months of the year.

The S. W. Boggs "Horological Instrument and Related Devices" U.S. Pat. No. 2,056,089, Sep. 29, 1936. This device uses a stationery earth disc instead of a rotating disc which makes it difficult to read. This device also uses a twenty-four hour clock in place of the more standard twelve hour clock. The north pole is not offset to make up for the tilt of the earth. There is no system to determine the months or seasons or the day of the year.

SUMMARY OF THE INVENTION

My patent is a clock and calendar that transforms the three dimensional view of the earth into a practical two dimensional representation. The clock part of this invention is a standard twelve hour time keeping system with a second, minute and hour hand.

The earth is viewed as it rotates on its polar axis. This particular view is of the northern hemisphere, however, this clock could be built to show the southern hemisphere as well. The view looking down at the northern hemisphere includes the Tropic of Capricorn just as you would see in a three dimensional view.

The disc representing the earth is offset from the center of the clock and rotates counter clockwise 366/365 revolutions per day. Covering this earth disc is a fixed aperture. This aperture causes the earth disc to be re-centered thus giving a more accurate view of the earth's spin by compensating for the earth's tilt.

Covering this earth disc and the aperture is a transparent disc that has a shaded semi-circle superimposed on its face. Said semi-circle it lined up to cast a shadow over one half of the earth. This transparent disc rotates once every 365 days in a counter clockwise direction. The purpose of this shaded area is to show the shadow caused by the absence of the sun's rays, thus creating night and day, also dawn and dusk. It also shows the various seasons, that is, summer, fall, winter, and spring. This disc also has a pointer located close to the outside edge which points to the month and day of the year.

Major cities of the northern hemisphere such as New York, London, Tokyo, Rome, etc. may be highlighted with colored dots to highlight their relative positions thereby giving the time of day for each city so marked. The north pole is marked with a star or some other device to show its location. The 24 time zone meridians are also shown radiating outward from the north pole.

This clock, calendar and earth model is encased in a rigid frame such as metal or plastic and the face is covered by a clear transparent material.

BRIEF DESCRIPTIONS OF THE DRAWINGS

DETAILED DESCRIPTION

Figure 1:
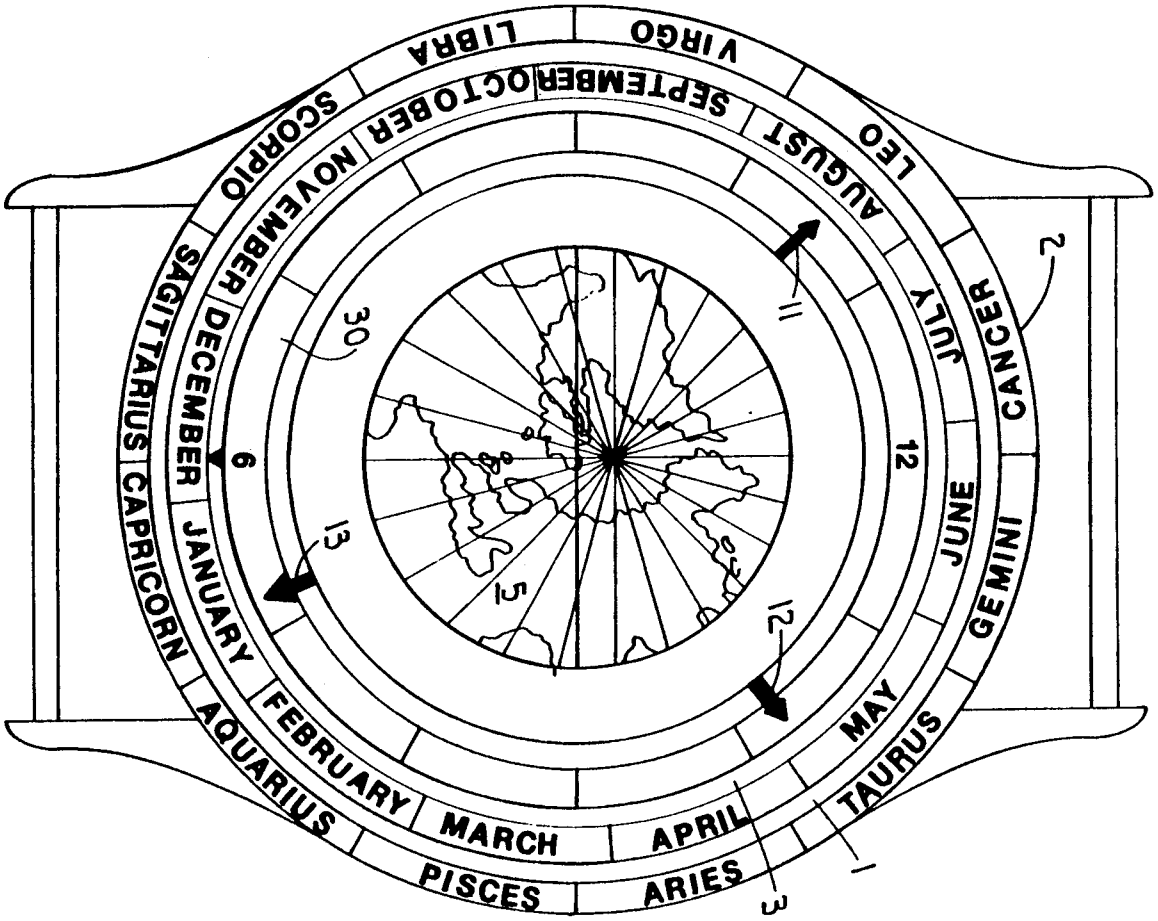
FIG. 1 is a plan view of the earth clock and calendar device.

As shown in the drawings, the earth clock and calendar device is shown as a wrist watch. It is not necessarily limited to a wrist watch but could be any size watch or clock. I have chosen the wrist watch format for explanation purposes and to show it can be built on a small scale.

DESCRIPTION OF THE PREFERRED CONFIGURATION

While this invention can be built in many different configurations, there are shown in these drawings certain arrangement of parts with the understanding that the present disclosure is to be considered as an example of the principles of the invention and not intended to limit said invention to the configurations illustrated. The scope of the invention will be pointed out in the section labeled claims.

Figure 2:
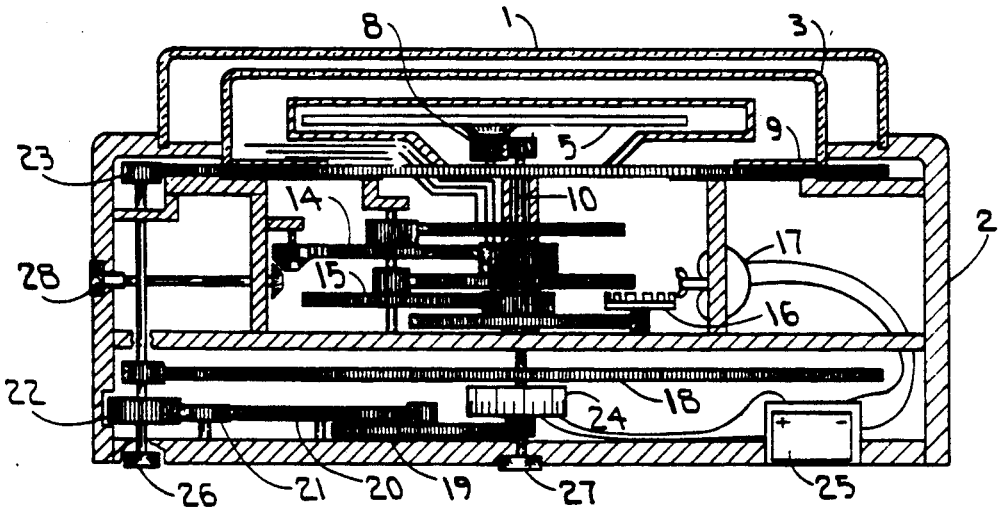
FIG. 2 is an enlarged sectional elevation view of the earth clock and calendar device.
Figure 3:
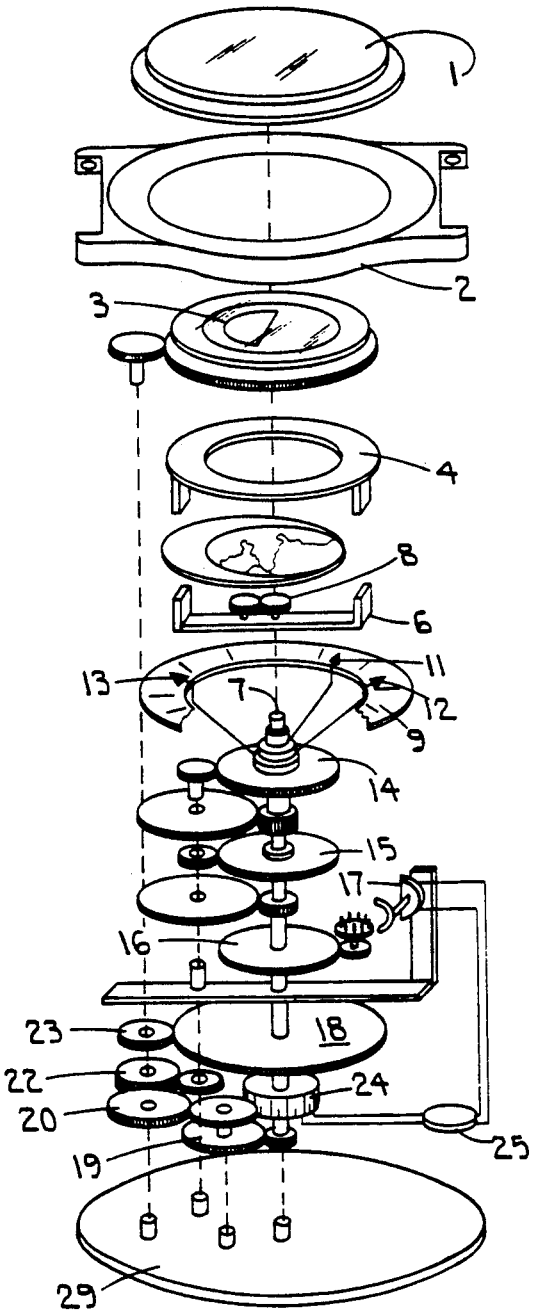
FIG. 3 is an exploded view of the earth clock and calendar device.

Referring to FIGS. 1, 2, and 3 the device is composed of a transparent material such as plastic or glass 1 that is set in a rigid frame such as plastic or metal 2 these above devices hold and protect the moving parts, and become part of the outside shell.

Underneath the protective transparent cover is another transparent disc 3, this disc is also a gear and has a shaded semi-circle superimposed on the face of said transparent disc. This disc rotates one revolution each 365 days and its axis is coincident with the axis of the clock frame.

Underneath the moving transparent disc is an aperture device 4 this is a opaque rigid material and is supported by braces that radiate from the center of the device 6. The braces 6 are attached to a hollow shaft 7 which is attached to the rigid clock frame. The axis of said shaft is coincident with the frame of the clock 2. The aperture has a diameter that is equal to the diameter of the semi-circle on the movable transparent disc. The aperture is fixed and its axis is coincident with the axis of the clock frame and the movable transparent disc.

Underneath said aperture is the earth disc 5 this is a disc made of rigid material and graphically represents the earth as it rotates around its polar axis. This earth disc rotates 366/365 revolutions per day. The earth disc's axis is not coincident with the axis of the aperture but is offset to show the tilt of the earth. The amount of the offset is equal, but not limited to one fourth of the aperture's radius.

Underneath said earth disc are two gears of equal size 8. These gears drive the earth disc 366/365 revolutions per day in a counter clockwise direction. The shaft 10 drives said gears and is hooked directly to the motor.

Underneath said earth disc is a clock dial 9 that represents the twelve positions of a standard twelve hour two revolutions per day clock system. This dial does not move and its axis is coincident with the frame of the clock.

Located under the earth disc and shaped in a way to come under the earth disc but over the clock dial are the hands of the clock; the second hand 11, the minute hand 12, and the hour hand 13. These said pointer hands are the standard type hands normally seen in a clock movement.

Coincident with the axis of the clock frame and mounted over the rigid hollow shaft 7 are the gears for the standard twelve hour clock system. The hour hand gears 14, the minute hand gears 15, the second hand gears 16.

The drive motor for the standard twelve hour clock system described above is 17, this is a quartz system that activates the gear system 16 driving the set of second hand gears. This is one of two quartz motors used in this device.

The second quartz motor shown 24 is attached to the large gear 18. This said motor drives the earth disc and also drives the system of gears 19, 20, 21, 22, and the two equal gears both shown as 23. Both large gears 3, and 18 have the same diameter and the same number of teeth, both said gears turn in unison and both make one revolution every 365 days. During leap year the clock will have to be readjusted.

The battery 25 activates both motors 17 and 24. Motor 24 axis is coincident with the axis of the clock's frame and said motor rotates one revolution per 365 days. This said motor uses a brush system to receive electric current because it revolves.

There are three stations to set the time and the position of the earth and the earth's shadow. The time set 26 sets the location of the earth's shadow. The time set 27 sets the location of the earth. The time set 28 sets the time of day for the standard twelve hour clock system.

The lower part of the rigid clock frame 29 locks together with the upper part 2 to complete the protective shell. The clock frame has the signs of the zodiac graphically displayed on the outside shoulder 30 and has the months and days of each month on the inside shoulder underneath the protective transparent covering 31.

I claim:

1. A world clock comprising:

a clock frame having a center;

a single rotating map disc being a dimensionally accurate polar projection of the earth's continents, including twenty-four symbolic lines radiating from the earth's pole and said lines representing the earth's twenty four meridians, said map having a diameter representing the equator;

a stationary time scale disc surrounding said rotating map, said time scale containing discrete units representing hours of the day, the months of the year and the signs of the zodiac, whereas these discrete symbols allow the user to readily tell the time of day, the day of the year, the month of the year and the sign of the zodiac;

a stationary apertured disc having an aperture with the same diameter as the equator, said stationary apertured disc being mounted above the map disc;

a rotating transparent disc mounted above the stationary apertured disc and above the rotating map disc, said transparent disc having light and dark semicircles printed thereon, said semicircles representing daylight and nightfall, said transparent disc further having a marker on its surface that points to the day of the month of the year along with the sign of the zodiac;

a set of symbols representing the locations of the major cities of the world and the earth's poles are printed on the rotating map disc;

a drive mechanism rotating said map disc at least once every twenty four hours; and wherein the center of the clock frame and the center of the time disc and the center of the transparent disc are coaxial and aligned; and wherein the map disc has the earth's pole at its center, said pole being offset from and not coincident with the aligned and coaxial centers.

2. A world clock as recited in claim 1 whereby said transparent disc rotates 1/365 revolutions per a 24 hour day in a counter clockwise direction for a disc for the northern hemisphere and a clockwise direction for the southern hemisphere, said transparent disc is mutually exclusive of the earth disc and said transparent disc has a marker printed on its surface that points to the day and month of the year along with the astrological sign of the zodiac.

3. A standard 12 hour clock as recited in claim 1 whereby 3 pointer rotating hands are mounted under said rotating world map, said hands or coincident with the stationary time scale, the short hand makes 2 revolutions per earth day, the medium length hand makes 24 revolutions per earth day and the longest hand makes 1,440 revolutions per earth day.

4. A world clock as recited in claim 1 or 2 said drive mechanism rotates said map 366/365 revolutions per 24 hours synchronized to the earth's rotation relative to the sun.

5. A world clock as recited in claims 1 and 2 wherein said discrete symbols are a plurality of numerals.

6. A device as recited in claim 1 wherein the world map has discrete symbols printed on said surface, each symbol represents the major cities of the northern (or southern) hemisphere, said rotating world map has a discrete symbol also placed at the location of the north (or south) pole, said world map has 24 symbolic meridian lines radiating from the polar axis.

* * * * *